US010373546B2

(12) United States Patent
Huang

(10) Patent No.: US 10,373,546 B2
(45) Date of Patent: Aug. 6, 2019

(54) IMAGE DISPLAY METHOD AND DEVICE

(71) Applicant: HISENSE ELECTRIC CO., LTD., Qingdao (CN)

(72) Inventor: Shunming Huang, Qingdao (CN)

(73) Assignees: Hisense Electric Co., Ltd., Qingdao (CN); Hisense USA Corporation, Suwanee, GA (US); Hisense International Co., Ltd., Qingdao (CN)

( * ) Notice: Subject to any disclaimer, the term of this patent is extended or adjusted under 35 U.S.C. 154(b) by 484 days.

(21) Appl. No.: 14/799,822

(22) Filed: Jul. 15, 2015

(65) Prior Publication Data

US 2016/0217593 A1 Jul. 28, 2016

(30) Foreign Application Priority Data

Jan. 23, 2015 (CN) ..... 2015 1 0036782

(51) Int. Cl.
*G09G 3/20* (2006.01)
*G09G 3/36* (2006.01)

(52) U.S. Cl.
CPC ..... *G09G 3/207* (2013.01); *G09G 3/3637* (2013.01); *G09G 3/2074* (2013.01); *G09G 2320/0276* (2013.01); *G09G 2320/10* (2013.01); *G09G 2340/0428* (2013.01)

(58) Field of Classification Search
None
See application file for complete search history.

(56) References Cited

U.S. PATENT DOCUMENTS

| | | | | |
|---|---|---|---|---|
| 7,800,634 | B2 | 9/2010 | Baek et al. | |
| 2006/0007091 | A1* | 1/2006 | Yang | G09G 3/3648 345/89 |
| 2008/0030435 | A1* | 2/2008 | Kim | G09G 3/3233 345/76 |
| 2008/0068359 | A1* | 3/2008 | Yoshida | G09G 3/3406 345/204 |
| 2010/0033473 | A1 | 2/2010 | Hsieh | |

FOREIGN PATENT DOCUMENTS

| | | |
|---|---|---|
| CN | 103474042 A | 12/2013 |
| CN | 103955279 A | 7/2014 |

OTHER PUBLICATIONS

Office Action from corresponding Chinese Application No. 201510036782.9 dated Oct. 17, 2017 (14 pages).

* cited by examiner

*Primary Examiner* — Aaron M Richer
(74) *Attorney, Agent, or Firm* — Harness, Dickey & Pierce, P.L.C.

(57) ABSTRACT

The disclosure provides an image display method and device. An image display method applicable a multi-domain display device includes: obtaining grayscales of respective pixels in one frame of input image; determining grayscales of the respective pixels in two adjacent frames of output image according to the grayscales of the respective pixels in the frame of input image, wherein the grayscale of any pixel in one of the two adjacent frames of output image is higher than the grayscale of the pixel in the input image, and the grayscale of the pixel in the other frame is lower than the grayscale of the pixel in the input image; and displaying the two adjacent frames of output image.

19 Claims, 7 Drawing Sheets

| Grayscale in the input image | Lower grayscale than in the input image | Higher grayscale than in the input image |
|---|---|---|
| 0 | 0 | 0 |
| ...<br>25<br>...<br>160<br>... | ...<br>20<br>...<br>120<br>... | ...<br>30<br>...<br>200<br>... |
| 255 | 255 | 255 |

| Grayscale | 0 ··· 20 ··· 25 ··· 30 ··· 120 ··· 160 ··· 200 ··· 255 |
|---|---|
| Transmittance ratio | 0% ··· 0.3% ··· 0.6% ··· 0.9% ··· 20% ··· 36% ··· 58% ··· 100% |

| The i-th frame of output image | | The (i+1)-th frame of output image | |
|---|---|---|---|
| a<br>Higher grayscale than in the input image | b<br>Lower grayscale than in the input image | a<br>Lower grayscale than in the input image | b<br>Higher grayscale than in the input image |
| c<br>Lower grayscale than in the input image | d<br>Higher grayscale than in the input image | c<br>Higher grayscale than in the input image | d<br>Lower grayscale than in the input image |

Fig.13

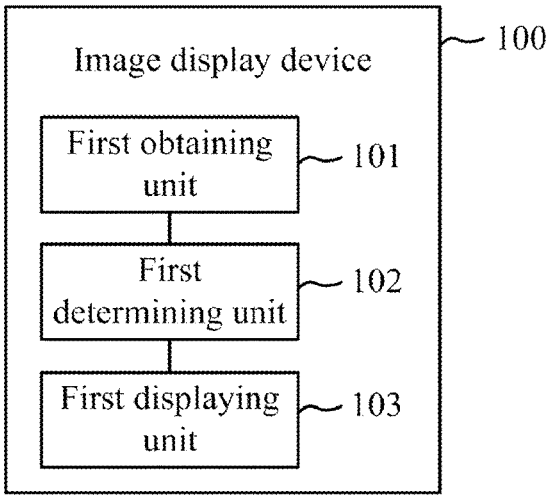

Fig.14

IMAGE DISPLAY METHOD AND DEVICE

CROSS-REFERENCE TO RELATED APPLICATION

This application claims the benefit and priority of Chinese Patent Application No. 201510036782.9 filed Jan. 23, 2015. The entire disclosure of the above application is incorporated herein by reference.

FIELD

The present disclosure relates to the field of display technologies and particularly to an image display method and device.

BACKGROUND

This section provides background information related to the present disclosure which is not necessarily prior art.

A clearer image has been pursued all the time in the field of electronic video display and broadcast, and the definition of an image is improved primarily by improving the resolution of display because a picture can be displayed at more levels at higher resolution so that the picture can be perceived in more colors and details. In order to pursue a higher quality of display, the resolution of display has evolved from the Standard Definition (SD) of 480p to the High Definition (HD) of 720p and further to the Full High Definition (FHD) of 1080p and up to the latest Ultra High Definition (UHD) of 4K at which the display has come to the field of civil applications, so there is an apparent trend of pursuing the high resolution of display in the field of display technologies.

SUMMARY

This section provides a general summary of the disclosure, and is not a comprehensive disclosure of its full scope or all of its features.

In an aspect, an embodiment of the disclosure provides an image display device applicable to a multi-domain display device, the image display device including a memory and one or more processor, wherein the memory stores one or more computer readable program codes, and the one or more processors are configured to execute the one or more computer readable program codes to perform:

obtaining grayscales of respective pixels in one frame of input image;

determining grayscales of the respective pixels in two adjacent frames of output image according to the grayscales of the respective pixels in the frame of input image, wherein for any pixel, the grayscale of the pixel in one of the two adjacent frames of output image is higher than the grayscale of the pixel in the input image, and the grayscale of the pixel in the other frame is lower than the grayscale of the pixel in the input image; and displaying the two adjacent frames of output image according to the grayscales of the respective pixels in the two adjacent frames of output image.

In another aspect, an embodiment of the disclosure provides an image display device applicable to a multi-domain display device, the image display device including a memory and one or more processor, wherein the memory stores one or more computer readable program codes, and the one or more processors are configured to execute the one or more computer readable program codes to perform:

obtaining grayscales of respective pixels in the i-th frame of input image and the j-th frame of input image, which are two adjacent frames;

determining grayscales of the respective pixels in the i-th frame of output image according to the grayscales of the respective pixels in the i-th frame of input image;

determining grayscales of the respective pixels in the j-th frame of output image according to the grayscales of the respective pixels in the j-th frame of input image, wherein for any pixel, the grayscale of the pixel in the i-th frame of output image is higher than the grayscale of the pixel in the i-th frame of input image, and the grayscale of the pixel in the j-th frame of output image is lower than the grayscale of the pixel in the j-th frame of input image; and displaying the i-th frame of output image and the j-th frame of output image.

In a further aspect, an embodiment of the disclosure provides an image display method applicable to a multi-domain display device, the method including:

obtaining grayscales of respective pixels in one frame of input image;

determining grayscales of the respective pixels in two adjacent frames of output image according to the grayscales of the respective pixels in the one frame of input image, wherein for any pixel, the grayscale of the pixel in one of the two adjacent frames of output image is higher than the grayscale of the pixel in the input image, and the grayscale of the pixel in the other one of the two adjacent frames of output image is lower than the grayscale of the pixel in the input image; and displaying the two adjacent frames of output image according to the grayscales of the respective pixels in the two adjacent frames of output image.

In a still further aspect, an embodiment of the disclosure provides another image display method applicable to a multi-domain display device, the method including:

obtaining grayscales of respective pixels in the i-th frame of input image and the j-th frame of input image, which are two adjacent frames;

determining grayscales of the respective pixels in the i-th frame of output image according to the grayscales of the respective pixels in the i-th frame of input image;

determining grayscales of the respective pixels in the j-th frame of output image according to the grayscales of the respective pixels in the j-th frame of input image, wherein for any pixel, the grayscale of the pixel in the i-th frame of output image is higher than the grayscale of the pixel in the i-th frame of input image, and the grayscale of the pixel in the j-th frame of output image is lower than the grayscale of the pixel in the j-th frame of input image; and displaying the i-th frame of output image and the j-th frame of output image.

Further aspects and areas of applicability will become apparent from the description provided herein. It should be understood that various aspects of this disclosure may be implemented individually or in combination with one or more other aspects. It should also be understood that the description and specific examples herein are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 13 illustrates a schematic diagram of spatial compensation for a pixel according to an embodiment of the disclosure;

FIG. 14 illustrates a schematic diagram of an image display device according to an embodiment of the disclosure;

REFERENCE NUMERALS

Figure 1:
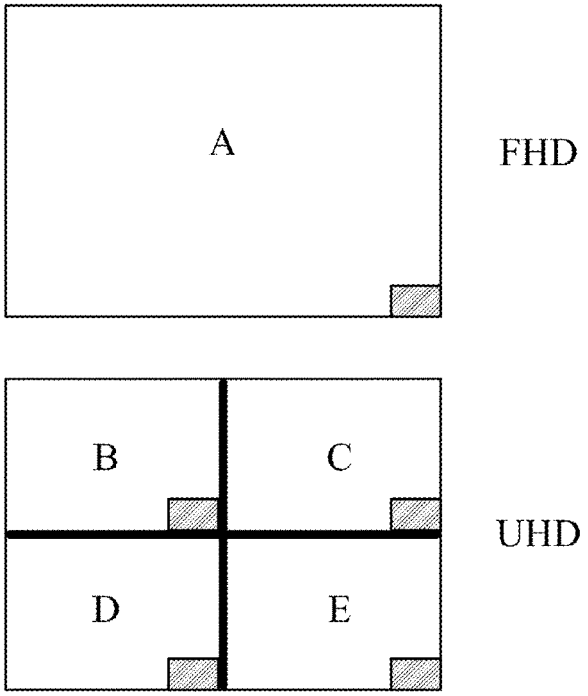
FIG. 1 illustrates a schematic diagram of comparing a UHD display pixel and FHD display pixels.

1—Upper substrate; 2—lower substrate; 11—protrusion on the upper substrate; 13—black matrix; 101—first sub-pixel; 102—second sub-pixel; and 21—protrusion on the lower substrate.

Corresponding reference numerals indicate corresponding parts throughout the several views of the drawings.

DETAILED DESCRIPTION

Example embodiments will now be described more fully with reference to the accompanying drawings.

An display panel at the Ultra High Definition of 4K is provided with pixels, the number of which is increased by a factor of four as compared with a display panel at the Full High Definition, so the resolution at the UHD is four times that at the FHD. Particularly as illustrated in FIG. 1, the total area of four pixels B, C, D and E on the UHD is the same as the area of one pixel A on the FHD display panel. Due to the less number of pixels, the numbers of data lines, gate lines, etc., on the display panel become less, and black matrixes are required for the data lines, the gate lines, etc., to shield light, thus degrading the overall light transmittance ratio of the pixels. Taking a 55-inch panel as an example, the transmittance ratio of the FHD panel is approximately 6%, and the transmittance ratio of the UHD panel is approximately 4%.

In order to improve the transmittance ratio, the number of domains on the display panel is generally lowered, for example, by changing original eight domains to four domains, but the angle of view of the display panel may be degraded due to the small number of domains.

The transmittance ratio is generally improved by lowering the number of domains on the display panel, for example, by changing original eight domains to four domains. Both an image display method and device according to the embodiments of the disclosure can be applicable to a multi-domain display device. In order to facilitate understanding of the technical solutions according to the embodiments of the disclosure, firstly the principle of multi-domain display will be described.

Figure 2:
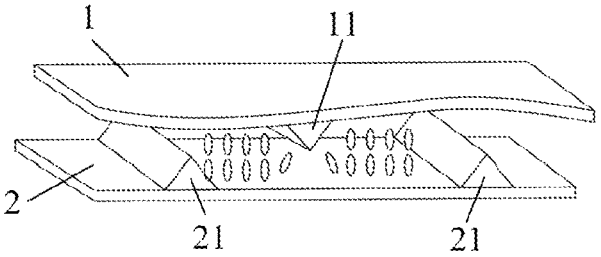
FIG. 2 illustrates a schematic diagram of liquid crystals arranged according to an embodiment of the disclosure when no voltage is applied in an existing display in the VA mode.
Figure 3:
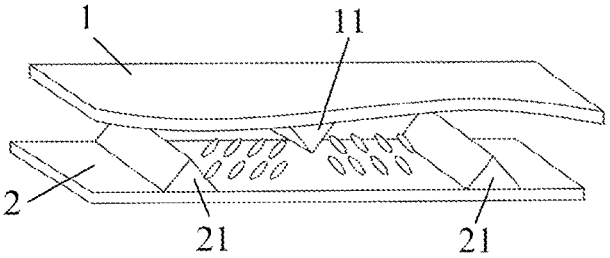
FIG. 3 illustrates a schematic diagram of liquid crystals arranged when voltage is applied in the display illustrated in FIG. 2.

FIG. 2 illustrates a display in a dual-domain Vertical Alignment (VA) mode. When no voltage is applied, long axes of liquid crystal molecules between an upper substrate 1 and a lower substrate 2 are perpendicular to a screen, and only liquid crystal molecules proximate to protrusions (i.e., protrusions 11 on the upper substrate 1 and protrusions 21 on the lower substrate 2 illustrated in FIG. 2) (i.e., electrodes) are slightly inclined so that light rays cannot pass the display panel at that time. When voltage is applied, as illustrated in FIG. 3, the liquid crystal molecules proximity to the protrusions rapidly bring the other liquid crystal molecules into rotation until their long axes are perpendicular to the surfaces of the protrusions, and an electric field between the protrusions 11 on the upper substrate 1 and the protrusions 21 on the lower substrate 2 is controlled to thereby adjust a deflection angle of the liquid crystal molecules so as to adjust the transmittance ratio of light rays. In this dual-domain mode, as illustrated in FIG. 3, the long axes of the liquid crystal molecules on both sides of the protrusions 11 on the upper substrate 1 are symmetric and points in different directions, and optical compensation is performed for the display in the dual-domain VA mode due to the long axes of the molecules pointing in the different directions.

Figure 4:
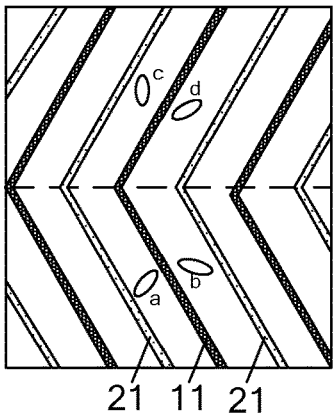
FIG. 4 illustrates a schematic diagram of pixels on a four-domain display according to an embodiment of the disclosure.

As illustrated in FIG. 4, when a protrusion in a pixel is arranged zigzag, liquid crystal molecules can be divided into four domains. In the event that voltage is applied in a display in a four-domain mode, liquid crystal molecules a, b, c and d in the respective domains are rotated respectively towards four directions to thereby compensate for up, down, left and right visual angles on the liquid crystal display concurrently, so there are good visual angles in all of these four directions on the VA liquid crystal display in the four-domain mode.

Figure 5:
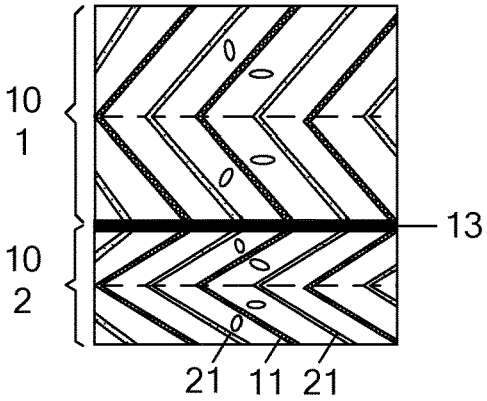
FIG. 5 illustrates a schematic diagram of pixels on an eight-domain display according to an embodiment of the disclosure.

Based upon such a compensation principle, any visual angles can be compensated for by a less number of liquid crystal domains in different directions to thereby achieve a better visual angle effect. As illustrated in FIG. 5, there is illustrated a VA liquid crystal display in an eight-domain mode, and one pixel includes a first sub-pixel 101, and a second sub-pixel 102, both of which are sized differently so that there is some difference in voltage between the first sub-pixel and the second sub-pixel. Each sub-pixel is a four-domain, and two sub-pixels are eight-domain, that is, the number of sub-pixels in the eight-domain mode is twice the sub-pixel in the four-domain mode. Thus the display may be more difficult to fabricate, and gate lines, data lines, etc., need to be arranged between two sub-pixels by shielding light using black matrixes 13, thus decreasing the area where light is transmitted by the pixels, that is, lowering the transmittance ratio of the pixels. Thus the visual angle of the display panel may be degraded although the transmittance ratio is improved by lowering the number of domains on the display panel. With an image display method according to an embodiment of the disclosure, the display effect of eight domains can be achieved on a four-domain display panel to thereby achieve the ultra-high-definition display with a high transmittance ratio and a large visual angle.

Figure 6:
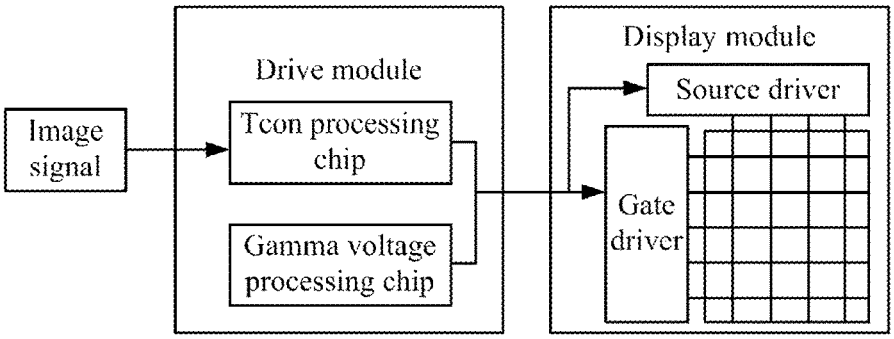
FIG. 6 illustrates a schematic diagram of a display drive principle according to an embodiment of the disclosure.

FIG. 6 illustrates a display principle of any type of display device. A Tcon processing chip processes a frame of image signal in the LVDS format into grayscales of respective pixels on a corresponding display module; a Gamma voltage processing chip is primarily configured to output reference voltages corresponding to the grayscales; and a source driver receives the grayscales of the respective pixels in the frame of image output by the Tcon processing chip, and the reference voltages corresponding to the grayscales output by the Gamma voltage processing chip, and calculates and outputs data voltage corresponding to the grayscales of the respective pixels. Taking a liquid crystal display device as an example, liquid crystal molecules of different pixels are controlled by different data voltage to be deflected by different angles so that corresponding grayscales are displayed by the pixels. Taking an organic light-emitting diode display device as an example, strength of an electric field of a light-emitting function layer is varied along the different data voltage to thereby control display brightness of pixels to display corresponding grayscales.

Of course, another chip or the like in the display device can alternatively process the grayscales and input the grayscales of the respective pixels in the frame of image to the liquid crystal display module, although the Tcon processing chip processes the image signal, and obtains and outputs the grayscales of the respective pixels in the frame of image to the liquid crystal display module, as described in details in the embodiment of the disclosure.

In order to enable those skilled in the art to understand the disclosure more clearly, the technical solutions according to the embodiments of the disclosure will be described below in details with reference to the drawings.

First Embodiment

Embodiments of the disclosure provide an image display method and device applicable to a multi-domain display device, which can be a TV set, a network video player, etc., in practice. In the embodiments of the disclosure, the multi-domain display device which is a four-domain liquid crystal TV set with the resolution of 3800×2160 will be described as an example.

Figures 7, 8, 9:
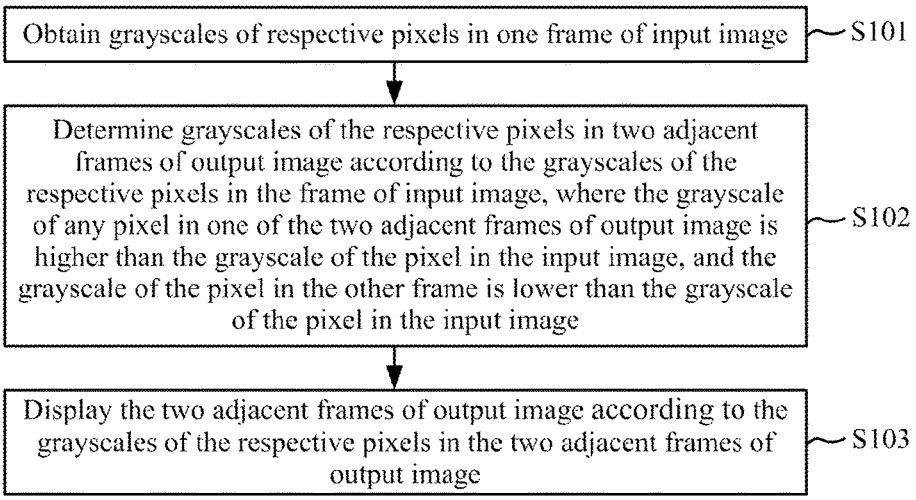
FIG. 7 illustrates a schematic flow chart of an image displaying method according to an embodiment of the disclosure.
FIG. 8 illustrates a schematic diagram of a lookup table of grayscales of respective pixels in an input image and grayscales of the respective pixels in an output image according to an embodiment of the disclosure.
FIG. 9 illustrates a schematic diagram of a lookup table of correspondence between a grayscale and a transmittance ratio according to an embodiment of the disclosure.

As illustrated in FIG. 7, a first embodiment of the disclosure provides an image display method including:

Operation 101: obtain grayscales of respective pixels in one frame of input image.

That is, 3800×2160 grayscales corresponding to 3800×2160 pixels are obtained.

Operation 102: determine grayscales of the respective pixels in two adjacent frames of output image from the grayscales of the respective pixels in the one frame of input image, where the grayscale of any pixel in one of the two adjacent frames of output image is higher than the grayscale of the pixel in the input image, and the grayscale of the pixel in the other one of the two adjacent frames of output image is lower than the grayscale of the pixel in the input image.

By way of an example, the grayscale of one of the 3800×2160 pixels in the frame of input image is 160, for example, and the grayscales of the pixel in the two adjacent frames of output image are determined respectively as 120 and 200, that is, the grayscale (i.e., 120) of the pixel in one of the two adjacent frames of output image is lower than the grayscale (i.e., 160) of the pixel in the frame of input image; and the grayscale (i.e., 200) of the pixel in the other one of the two adjacent frames of output image is higher than the grayscale (i.e., 160) of the pixel in the frame of input image. The grayscales of the respective pixels in the two frames of output image determined from the grayscales of the respective pixels in the frame of input image satisfy the relationship above between their sizes, that is, the grayscales of the respective pixels in the frame of input image are displayed respectively by the different grayscales of the two adjacent frames of output image.

The grayscales of the respective pixels in the two adjacent frames of output image are determined from the grayscales of the respective pixels in the one frame of input image. That is, two adjacent frames of output image are determined from each frame of input image, for example, two adjacent frames of output image are determined from a first frame of input image, and further two adjacent frames of output image are determined from a second frame of input image, that is, four frames of output image are determined from the two frames of input image, and the number of frames of output image is twice the number of frames of input image.

It shall be noted here that the grayscale of a pixel corresponds to the transmittance ratio of the pixel. In the embodiment of the disclosure, different grayscales correspond to different transmittance ratios. If the grayscales of the respective pixels in the frame of input image are displayed respectively as the different grayscales in the two adjacent frames of output image, then the average of the grayscales of any pixel in the two adjacent frames of output image can be larger or smaller than or equal to the grayscale of the pixel in the frame of input image, although the embodiment of the disclosure will not be limited thereto.

Operation 103: display the two adjacent frames of output image according to the grayscales of the respective pixels in the two adjacent frames of output image.

That is, data voltage corresponding to the respective pixels is output by a display module of the four-domain liquid crystal TV set to display the two adjacent frames of output image on the display device.

The embodiment of the disclosure provides such an image display method that one frame of input image is displayed respectively as two adjacent frames of output image so that the grayscale of any pixel in one of the two adjacent frames of output image is higher than the grayscale of the pixel in the frame of input image, and the grayscale of the pixel in the other one of the two adjacent frames of output image is lower than the grayscale of the pixel in the frame of input image, so the displayed grayscale is superimposition of the grayscales in the two frames of output image due to the temporal integration effect in human eyes. For the four-domain display device, four different directed vectors of liquid crystals can be seen in each frame, so eight different directed vectors of liquid crystals can be seen two adjacent frames by the human eyes to thereby improve the visual angle for display, that is, a display effect from the visual angle in eight domains can be achieved on the four-domain display device to thereby achieve both a high transmittance ratio and a large visual angle on the ultra-high-definition display without modifying the display panel.

In one or more embodiments, the operation 101 above includes obtaining the one frame of input image at a first frequency and obtaining the grayscales of the respective pixels in the one frame of input image; and the operation 103 above includes displaying the two adjacent frames of output image at a second frequency which is twice the first frequency.

The existing four-domain liquid crystal TV set obtains a frame of input image at the same frequency as the frequency at which a frame of output image is output, which is typically 60 Hz. In the image display method according to the embodiment of the disclosure, the four-domain liquid crystal TV set obtains one frame of input image at the frequency of 60 Hz, and obtains grayscales of 3800×2160 pixels in the one frame of input image, and outputs two adjacent frames of output image at the frequency of 120 Hz. That is, as compared with the existing four-domain liquid crystal TV set, the image display frequency in the four-domain liquid crystal TV set in the embodiment of the disclosure is twice the frequency, that is, one frame of image is displayed as two adjacent frames of image, and the doubling in display frequency (i.e., from existing 60 Hz to 120 Hz in the embodiment of the disclosure) can shorten a period of time for displaying each frame of image so that the difference between the two frames will be unperceivable by the human eyes to thereby further improve the display visual angle effect on the high-resolution display.

In one or more embodiments, the grayscales of the respective pixels in the two adjacent frames of output image are determined from the grayscales of the respective pixels in the one frame of input image by determining the grayscales of the respective pixels in the two adjacent frames of output image from the grayscales of the respective pixels in the one frame of input image according to a preset relationship between the grayscales of the respective pixels in the input image and the grayscales of the respective pixels in the output image.

The preset relationship between the grayscales of the respective pixels in the input image and the grayscales of the respective pixels in the output image can be as illustrated in FIG. 8, which is a lookup table including the grayscales of the pixels in the input image and the grayscales of the pixels in the output image, and the grayscales of the respective pixels in the two adjacent frames of output image are determined by referring to the lookup table as illustrated in FIG. 8.

Particularly taking the grayscale 160 of a pixel in the frame of input image as an example, the grayscales of the pixel in the two adjacent frames of output image can be determined respectively as 120 and 200 by referring to the lookup table as illustrated in FIG. 8. Alike the grayscales, respective pixels in the two adjacent frames of output image, corresponding to the respective pixels in the frame of input image, can be determined by referring to the lookup table as illustrated in FIG. 8. It shall be noted here that in the embodiment of the disclosure, the same grayscale corresponds to the same transmittance ratio, and as illustrated in FIG. 9, the grayscale 20 corresponds to the transmittance ratio 0.3%, and the grayscale 160 corresponds to the transmittance ratio 36%, in both the frame of input image and the frames of output image. In the embodiment of the disclosure, the grayscale corresponds to the transmittance ratio so that one of the two grayscales of any pixel in the two adjacent frames of output image is less than the grayscale of the pixel in the frame of input image, that is, the transmittance ratio of the pixel in one of the frames of output image is less than the transmittance ratio of the pixel in the frame of input image; and the other grayscale of the pixel is less than the grayscale of the pixel in the frame of input image, that is, the transmittance ratio of the pixel in the other frame of output image is less than the transmittance ratio of the pixel in the frame of input image. In the embodiment of the disclosure, if the grayscales of the respective pixels in the frame of input image are displayed respectively as the different grayscales in the two adjacent frames of output image, then the average of the grayscales of any pixel in the two adjacent frames of output image can be more or less than or equal to the grayscale of the pixel in the input image, and the transmittance ratios, in the two adjacent frames of output image, corresponding to the pixel can be more or less than or equal to the transmittance ratio of the pixel in the frame of input image, although the embodiment of the disclosure will not be limited thereto.

Of course, the lookup table will not be limited to the form illustrated in FIG. 8, but two lookup tables can alternatively be set so that the grayscales of the respective pixels in the two adjacent frames of output image can be obtained respectively from the lookup tables. Moreover the preset relationship between the grayscales of the respective pixels in input image and the grayscales of the respective pixels in the output image can alternatively be stored as a calculation relationship or another relationship, although the lookup table in the form illustrated in FIG. 8 has been described in the embodiment of the disclosure merely as an example.

In one or more embodiments, if the grayscale of a pixel in the frame of input image lies in grayscale intervals of 0 to 25 and 230 to 255, then the differences between the transmittance ratios corresponding to the grayscales of the pixel in the frames of output image and the transmittance ratio corresponding to the grayscale of the pixel in the frame of input image are no more than 10%; and if the grayscale of a pixel in the frame of input image lies in a grayscale interval of 26 and 229, then the differences between the transmittance ratios corresponding to the grayscales of the pixel in the frames of output image and the transmittance ratio corresponding to the grayscale of the pixel in the frame of input image are no more than 40%.

Particularly taking as an example the preset lookup table illustrated in FIG. 8 and the grayscales 25 and 160 respectively of two pixels in the frame of input image. If the grayscale of a pixel in the frame of input image is 25, then referring to FIG. 9, the transmittance ratio corresponding thereto is 10%, and the grayscales of the pixel in the two adjacent frames of output image are 20 and 30 respectively by referring to the lookup table illustrated in FIG. 8, where the transmittance ratio corresponding to the grayscale 20 is 0.3%, and the transmittance ratio corresponding to the grayscale 30 is 0.9%, so the differences between both of the transmittance ratios and the transmittance ratio of the pixel in the frame of input image are equal to 2%, that is, the differences between the transmittance ratios corresponding to the grayscales of the pixel in the frames of output image and the transmittance ratio corresponding to the grayscale of the pixel in the frame of input image are no more than 10%. If the grayscale of a pixel in the frame of input image is 160, then referring to FIG. 9, the transmittance ratio corresponding thereto is 36%, and the grayscales of the pixel in the two adjacent frames of output image are 120 and 200 respectively by referring to the lookup table illustrated in FIG. 8, where the transmittance ratio corresponding to the grayscale 120 is 20%, and the transmittance ratio corresponding to the grayscale 200 is 58%, so the differences between both of the transmittance ratios and the transmittance ratio of the pixel in the frame of input image are 16% and 22% respectively, that is, the differences between the transmittance ratios corresponding to the grayscales of the pixel in the frames of output image and the transmittance ratio corresponding to the grayscale of the pixel in the frame of input image are more than 10% but less than 40%.

This is because for a relatively white grayscale lying in the grayscale interval of 0 to 25 and a relatively black grayscale lying in the grayscale interval of 230 to 255, an increase in grayscale has an insignificant influence on the transmittance ratio, whereas for a moderate grayscale lying in the grayscale interval of 26 to 229, an increase in grayscale has a significant influence on the transmittance ratio. In one or more embodiments, in order to avoid an influence upon brightness deviations in black and white fields, when the grayscale is relatively white or black, the differences between the transmittance ratios corresponding to the grayscales of the pixel in the frames of output image and the transmittance ratio corresponding to the grayscale of the pixel in the image of input image are no more than 10%, and when the grayscale is moderate, the differences between the transmittance ratios corresponding to the grayscales of the pixel in the frames of output image and the transmittance ratio corresponding to the grayscale of the pixel in the image of input image are no more than 40%.

The preset lookup table can be derived below in several particular examples.

First Example

Figure 10:
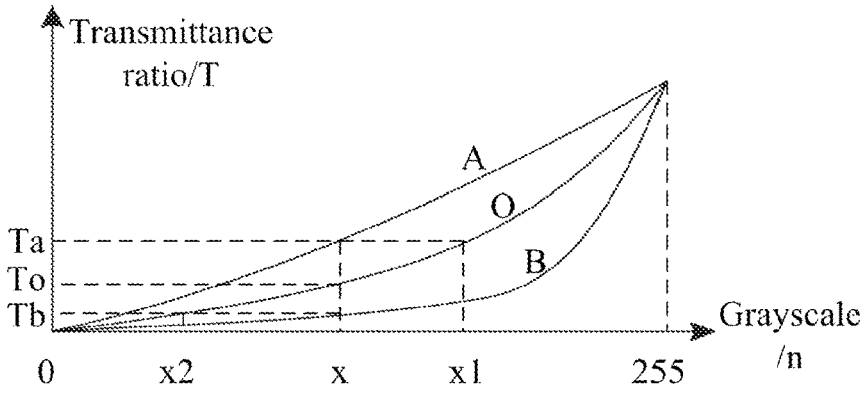
FIG. 10 illustrates a schematic diagram of principle curves according to an embodiment of the disclosure.

Taking any grayscale x as an example, the preset lookup table will be derived from the principle curves as illustrated in FIG. 10 as described below. Referring to the principle curves as illustrated in FIG. 10, the curve O represents a grayscale curve corresponding to the input image, the curve A represents a grayscale curve of the grayscales in the output image higher than the grayscale in the frame of input image, and the curve B represents a grayscale curve of the grayscales in output image lower than the grayscale in the frame of input image. As illustrated in FIG. 10, the transmittance ratio corresponding to the curve A is more than the transmittance ratio corresponding to the curve O, and the transmittance ratio corresponding to the curve B is less than the transmittance ratio corresponding to the curve O, at the same grayscale. For example, for the grayscale x, the transmittance ratio corresponding to the curve O is To, the transmittance ratio corresponding to the curve A is Ta, and the transmittance ratio corresponding to the curve B is Tb, where Tb<To<Ta.

When the grayscale in the input image is x, the transmittance ratio, on the curve O, corresponding to the grayscale x is To, and the transmittance ratio, on the curve A, corresponding to the grayscale x is Ta, where To<Ta, and the corresponding grayscale of Ta on the curve O is x1, that is, the grayscale in the output image more than the grayscale x is determined as x1; and alike when the grayscale in the frame of input image is x, the transmittance ratio, on the curve O, corresponding to the grayscale x is To, and the transmittance ratio, on the curve B, corresponding to the grayscale x is Tb, where To>Tb, and the corresponding grayscale of Tb on the curve O is x2, that is, the grayscale in the output image less than the grayscale x is determined as x2. Particularly if x is 160, then corresponding x1 can be 120, and corresponding x2 can be 200.

For each grayscale in the frame of input image, a corresponding grayscale higher than in the frame of input image and a corresponding grayscale lower than in the frame of input image can be determined as above to thereby derive the lookup table as illustrated in FIG. 8.

Optionally in the principle curves illustrated in FIG. 10, if x lies in the grayscale intervals of 0 to 25 and 230 to 255, then Ta−To≤10% and To−Tb≤10%; and if x lies in the grayscale interval of 26 to 229, then Ta−To≤40% and To−Tb≤40%, so that if the grayscale of a pixel of the frame of input image lies in the grayscale intervals of 0 to 25 and 230 to 255, then the differences between the transmittance ratios corresponding to the grayscales of the pixel in the frames of output image and the transmittance ratio corresponding to the grayscale of the pixel in the frame of input image are no more than 10%; and if the grayscale of a pixel of the frame of input image lies in the grayscale interval of 26 to 229, then the differences between the transmittance ratios corresponding to the grayscales of the pixel in the frames of output image and the transmittance ratio corresponding to the grayscale of the pixel in the frame of input image are no more than 40%.

It shall be noted here that in the principle curves illustrated in FIG. 10, To can be more or less than or equal to (Ta+Tb)/2, and Ta−To can be more or less than or equal to To−Tb, dependent the particular curves, although the embodiment of the disclosure will not be limited thereto.

Second Example

Figure 11:
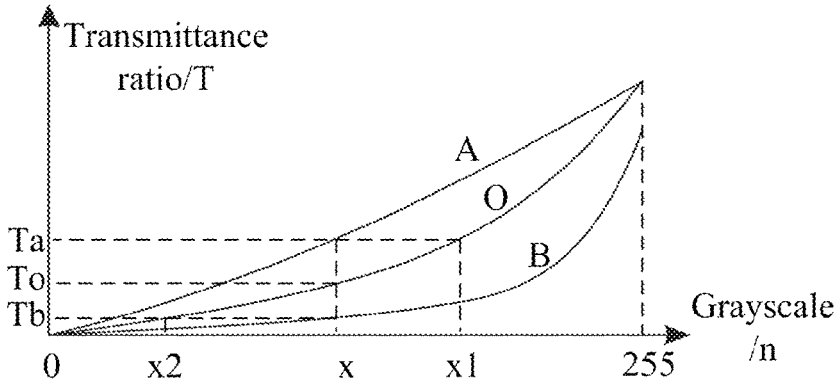
FIG. 11 illustrates a schematic diagram of other principle curves according to an embodiment of the disclosure.

The preset lookup table will be derived from the principle curves as illustrated in FIG. 11. The principle curves illustrated in FIG. 11 differ from the principle curves illustrated in FIG. 10 primarily in that the transmittance ratio corresponding to the highest grayscale, i.e., 255, on the curve B is less than the transmittance ratio corresponding to the highest grayscale, i.e., 255, on the curve O, and the transmittance ratio corresponding to the highest grayscale, i.e., 255, on the curve A is equal to the transmittance ratio corresponding to the highest grayscale, i.e., 255, on the curve O, as illustrated in FIG. 11.

The preset lookup table as illustrated in FIG. 8 can be derived from the principle curves illustrated in FIG. 11 under the same principle as the principle under which the preset lookup table as illustrated in FIG. 8 can be derived from the principle curves illustrated in FIG. 10. That is, when the grayscale in the frame of input image is x, the transmittance ratio, on the curve O, corresponding to the grayscale x is To, and the transmittance ratio, on the curve A, corresponding to the grayscale x is Ta, where To<Ta, and the corresponding grayscale of Ta on the curve O is x1, that is, the grayscale in the output image more than the grayscale x is determined as x1; and alike when the grayscale in the frame of input image is x, the transmittance ratio, on the curve O, corresponding to the grayscale x is To, and the transmittance ratio, on the curve B, corresponding to the grayscale x is Tb, where To>Tb, and the corresponding grayscale of Tb on the curve O is x2, that is, the grayscale in the output image less than the grayscale x is determined as x2. Particularly if x is 160, then corresponding x1 can be 120, and corresponding x2 can be 200.

For each grayscale in the frame of input image, a corresponding grayscale higher than in the frame of input image and a corresponding grayscale lower than in the frame of input image can be determined as above to thereby derive the lookup table as illustrated in FIG. 8.

Optionally in the principle curves illustrated in FIG. 11, if x lies in the grayscale intervals of 0 to 25 and 230 to 255, then Ta−To≤10% and To−Tb≤10%; and if x lies in the grayscale interval of 26 to 229, then Ta−To≤40% and To−Tb≤40%, so that if the grayscale of a pixel of the frame of input image lies in the grayscale intervals of 0 to 25 and 230 to 255, then the differences between the transmittance ratios corresponding to the grayscales of the pixel in the frames of output image and the transmittance ratio corresponding to the grayscale of the pixel in the frame of input image are no more than 10%; and if the grayscale of a pixel of the frame of input image lies in the grayscale interval of 26 to 229, then the differences between the transmittance ratios corresponding to the grayscales of the pixel in the frames of output image and the transmittance ratio corresponding to the grayscale of the pixel in the frame of input image are no more than 40%.

Of course, further to the principle curves illustrated in FIG. 11, alternatively the transmittance ratio corresponding to the highest grayscale, i.e., 255, on the curve B can be made equal to the transmittance ratio corresponding to the highest grayscale, i.e., 255, on the curve O, and the transmittance ratio corresponding to the highest grayscale, i.e., 255, on the curve A can be made more than the transmittance ratio corresponding to the highest grayscale, i.e., 255, on the curve O, as alternative principle curves; or the transmittance ratio corresponding to the highest grayscale, i.e., 255, on the curve B can be made less than the transmittance ratio corresponding to the highest grayscale, i.e., 255, on the curve O, and the transmittance ratio corresponding to the highest grayscale, i.e., 255, on the curve A can be made more than the transmittance ratio corresponding to the highest grayscale, i.e., 255, on the curve O.

It shall be noted here that in the principle curves illustrated in FIG. 11, To can be more or less than or equal to (Ta+Tb)/2, and Ta−To can be more or less than or equal to To−Tb, dependent upon the particular curves, although the embodiment of the disclosure will not be limited thereto.

Third Example

Figure 12:
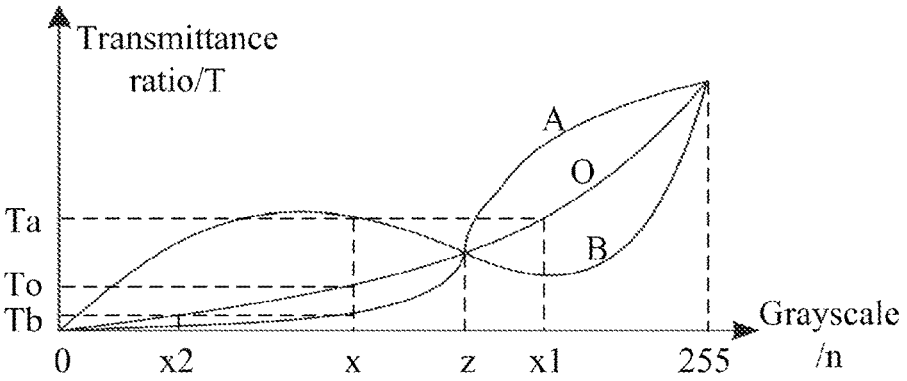
FIG. 12 illustrates a schematic diagram of further principle curves according to an embodiment of the disclosure.

The preset lookup table will be derived from the principle curves as illustrated in FIG. 12. The principle curves illustrated in FIG. 12 differ from the principle curves illustrated in FIG. 10 primarily in that the transmittance ratio corresponding to the grayscale on the curve A is less than the transmittance ratio corresponding to the grayscale on the curve O, and the transmittance ratio corresponding to the grayscale on the curve B is more than the transmittance ratio corresponding to the grayscale on the curve O, in the grayscale interval of 0 to z; and the transmittance ratio corresponding to the grayscale on the curve A is more than the transmittance ratio corresponding to the grayscale on the curve O, and the transmittance ratio corresponding to the grayscale on the curve B is less than the transmittance ratio corresponding to the grayscale on the curve O, in the grayscale interval of z to 255.

In the preset lookup table derived from the principle curves illustrated in FIG. 12, if the grayscale of any pixel in the frame of input image is z, then the grayscales of the pixel in the two frames of output image can be a preset grayscale more than z and a preset grayscale less than z. The grayscale in the output image lower than in the frame of input image is determined from the curve A, and the grayscale in the output image higher than in the frame of input image is determined from the curve B, in the grayscale interval of 0 to z; and the grayscale in the output image higher than in the frame of input image is determined from the curve A, and the grayscale in the output image lower than in the frame of input image is determined from the curve B, in the grayscale interval of z to 255.

The preset lookup table as illustrated in FIG. 8 can be derived from the principle curves illustrated in FIG. 12 under the same principle as the principle under which the preset lookup table as illustrated in FIG. 8 can be derived from the principle curves illustrated in FIG. 10. That is, when the grayscale in the frame of input image is x, the transmittance ratio, on the curve O, corresponding to the grayscale x is To, and the transmittance ratio, on the curve A, corresponding to the grayscale x is Ta, where To<Ta, and the corresponding grayscale of Ta on the curve O is x1, that is, the grayscale in the output image more than the grayscale x is determined as x1; and alike when the grayscale in the frame of input image is x, the transmittance ratio, on the curve O, corresponding to the grayscale x is To, and the transmittance ratio, on the curve B, corresponding to the grayscale x is Tb, where To>Tb, and the corresponding grayscale of Tb on the curve O is x2, that is, the grayscale in the output image less than the grayscale x is determined as x2. Particularly if x is 160, then corresponding x2 can be 120, and corresponding x1 can be 200.

For each grayscale in the frame of input image, a corresponding grayscale higher than in the frame of input image and a corresponding grayscale lower than in the frame of input image can be determined as above to thereby derive the lookup table including the grayscales of the respective pixels in the frame of input image and the grayscales of the respective pixels in the frames of output image.

Optionally in the principle curves illustrated in FIG. 12, if x lies in the grayscale intervals of 0 to 25 and 230 to 255, then Ta−To≤10% and To−Tb≤10%; and if x lies in the grayscale interval of 26 to 229, then Ta−To≤40% and To−Tb≤40%, so that if the grayscale of a pixel of the frame of input image lies in the grayscale intervals of 0 to 25 and 230 to 255, then the differences between the transmittance ratios corresponding to the grayscales of the pixel in the frames of output image and the transmittance ratio corresponding to the grayscale of the pixel in the frame of input image are no more than 10%; and if the grayscale of a pixel of the frame of input image lies in the grayscale interval of 26 to 229, then the differences between the transmittance ratios corresponding to the grayscales of the pixel in the frames of output image and the transmittance ratio corresponding to the grayscale of the pixel in the frame of input image are no more than 40%.

Of course, further to the principle curves illustrated in FIG. 12, alternatively the transmittance ratio corresponding to the highest grayscale, i.e., 255, on the curve B can be made equal to the transmittance ratio corresponding to the highest grayscale, i.e., 255, on the curve O, and the transmittance ratio corresponding to the highest grayscale, i.e., 255, on the curve A can be made more than the transmittance ratio corresponding to the highest grayscale, i.e., 255, on the curve O; or the transmittance ratio corresponding to the highest grayscale, i.e., 255, on the curve B can be made less than the transmittance ratio corresponding to the highest grayscale, i.e., 255, on the curve O, and the transmittance ratio corresponding to the highest grayscale, i.e., 255, on the curve A can be made equal to the transmittance ratio corresponding to the highest grayscale, i.e., 255, on the curve O; or the transmittance ratio corresponding to the highest grayscale, i.e., 255, on the curve B can be made less than the transmittance ratio corresponding to the highest grayscale, i.e., 255, on the curve O, and the transmittance ratio corresponding to the highest grayscale, i.e., 255, on the curve A can be made more than the transmittance ratio corresponding to the highest grayscale, i.e., 255, on the curve O.

It shall be noted here that in the principle curves illustrated in FIG. 12, To can be more or less than or equal to (Ta+Tb)/2, and Ta−To can be more or less than or equal to To−Tb, dependent upon the particular curves, although the embodiment of the disclosure will not be limited thereto.

Of course, the preset lookup table including the grayscales of the respective pixels in the frame of input image and the grayscales of the respective pixels in the frames of output image can alternatively be derived from other principle curves, although the particular principle thereof has been described in the embodiment of the disclosure merely taking the principle curves illustrated in FIG. 10 to FIG. 12 as examples.

In order to further improve the display effect in the first embodiment of the disclosure, an embodiment of the disclosure further provides a spatial compensation method such that the grayscale of one of any two adjacent pixels in one of the two adjacent frames of output image is higher than the grayscale of the pixel in the frame of input image, and the grayscale of the other pixel is lower than the grayscale of the pixel in the frame of input image.

Particularly as illustrated in FIG. 13, a, b, c and d represent four adjacent pixels, and the grayscales of the respective pixels in two adjacent frames of output image are determined from the grayscales of the respective pixels in one frame of input image, where the two adjacent frames of output image are the i-th frame of output image and the (i+1)-th frame of output image respectively. The grayscale of the pixel a in the i-th frame of output image is higher than the grayscale of the pixel a in the frame of input image, and the grayscale of the pixel a in the (i+1)-th frame of output image is lower than the grayscale of the pixel a in the frame of input image. The grayscales of the pixel b and the pixel c, adjacent to the pixel a, in the i-th frame of output image are lower than the grayscales of the pixel b and the pixel c in the frame of input image, and the grayscales of the pixel b and the pixel c in the (i+1)-th frame of output image are higher than the grayscales of the pixel b and the pixel c in the frame of input image.

An embodiment below of the disclosure provides an image display device corresponding to the image display method according to the first embodiment of the disclosure, and it shall be noted that respective function units included in the device below can perform corresponding operations in the method above, so the respective function units of the device will not be described in details in the embodiments below of the disclosure.

An embodiment of the disclosure provides an image display device 100 applicable to a multi-domain display device, and as illustrated in FIG. 14, the image display device 100 includes:

A first obtaining unit 101 is configured to obtain grayscales of respective pixels in one frame of input image.

Particularly, as illustrated in FIG. 6, the first obtaining unit can be the Tcon processing chip, or the first obtaining unit can be another processing chip or the like with the function of obtaining the grayscales of the respective pixels in one frame of input image. The first obtaining unit is particularly configured to obtain the one frame of input image at a first frequency and to obtain the grayscales of the respective pixels in the one frame of input image.

A first determining unit 102 is configured to determine grayscales of the respective pixels in two adjacent frames of output image from the grayscales of the respective pixels in the one frame of input image, where the grayscale of any pixel in one of the two adjacent frames of output image is higher than the grayscale of the pixel in the input image, and the grayscale of the pixel in the other one of the two adjacent frames of output image is lower than the grayscale of the pixel in the input image.

Particularly, as illustrated in FIG. 6, the first determining unit can also be the Tcon processing chip. The first determining unit is particularly configured to determine the grayscales of the respective pixels in the two adjacent frames of output image from the grayscales of the respective pixels in the frame of input image according to a preset relationship between the grayscales of the respective pixels in the input image and the grayscales of the respective pixels in output image. The preset relationship between the grayscales of the respective pixels in the input image and the grayscales of the respective pixels in the output image can be as illustrated in FIG. 8, which is a lookup table including the grayscales of the pixels in the input image and the grayscales of the pixels in the output image, and the grayscales of the respective pixels in the two adjacent frames of output image are determined by referring to the lookup table as illustrated in FIG. 8.

A first displaying unit 103 is configured to display the two adjacent frames of output image according to the grayscales of the respective pixels in the two adjacent frames of output image. The first displaying unit is particularly configured to display the two adjacent frames of output image at a second frequency which is twice the first frequency.

Particularly the first displaying unit can be the display module as illustrated in FIG. 6. Particularly the source driver in the display module can receive the grayscales of the respective pixels in the frame of image from the Tcon processing module and receive the reference voltages from the Gamma voltage processing chip, and then calculate and output data voltages of the respective pixels in the frame of image to the respective pixels through the data lines. Taking a liquid crystal display device as an example, liquid crystals in different pixels are controlled by different data voltage to be deflected by different angles so that corresponding grayscales are displayed by the pixels.

The embodiment of the disclosure provides such an image display device that one frame of input image is displayed respectively as two adjacent frames of output image so that the grayscale of any pixel in one of the two adjacent frames of output image is higher than the grayscale of the pixel in the frame of input image, and the grayscale of the pixel in the other frame of output image is lower than the grayscale of the pixel in the frame of input image, so the grayscale is displayed as superimposition of the grayscales in the two frames of output image due to the temporal integration effect in human eyes. For the four-domain display device, each frame can be seen as four different directed vectors of liquid crystals, so two adjacent frames can be seen by the human eyes as eight different directed vectors of liquid crystals to thereby improve the display angle of view characteristic, that is, a display effect from the angle of view of eight zones can be achieved on the four-domain display device to thereby achieve both a high transmittance ratio and a large angle of view on the ultra-high-definition display without modifying the display panel.

An embodiment of the disclosure provides a multi-domain display device including the image display device according to the first embodiment of the disclosure.

Second Embodiment

Embodiments of the disclosure provide another image display method and device applicable to a multi-domain display device, which can be a TV set, a network video player, etc., in practice. In the embodiments of the disclosure, the multi-domain display device which is a four-domain liquid crystal TV set with the resolution of 3800×2160 will be described as an example.

Figure 15:
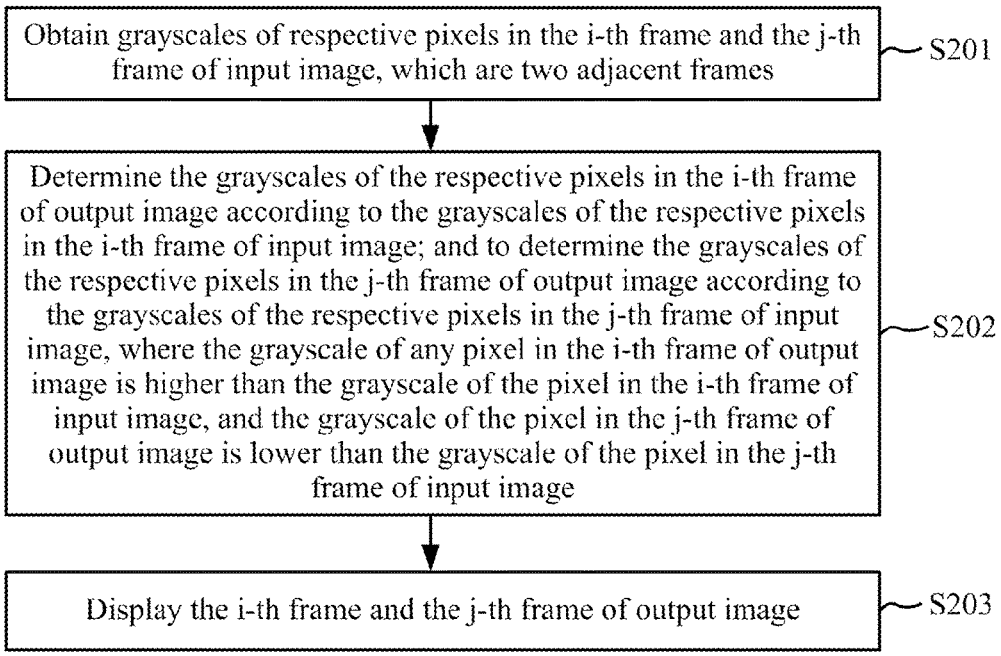
FIG. 15 illustrates a flow chart of an image displaying method according to another embodiment of the disclosure.

As illustrated in FIG. 15, a second embodiment of the disclosure provides an image display method including:

Operation 201: obtain grayscales of respective pixels in the i-th frame of input image and the j-th frame of input image, which are two adjacent frames.

Particularly if the i-th frame and the j-th frame are two adjacent frames, then the j-th frame can be the (i−1)-th frame, or the j-th frame can be the (i+1)-th frame. The embodiment of the disclosure will not be limited to any particular order of the i-th frame and the j-th frame.

Operation 202: determine the grayscales of the respective pixels in the i-th frame of output image from the grayscales of the respective pixels in the i-th frame of input image; and determine the grayscales of the respective pixels in the j-th frame of output image from the grayscales of the respective pixels in the j-th frame of input image, where the grayscale of any pixel in the i-th frame of output image is higher than the grayscale of the pixel in the i-th frame of input image, and the grayscale of the pixel in the j-th frame of output image is lower than the grayscale of the pixel in the j-th frame of input image (that is, for a pixel, the grayscale of the pixel in one of the i-th frame and j-th frame of output image is higher than the grayscale of the pixel in corresponding frame of input image, and the grayscale of the pixel in the other one of i-th frame and j-th frame of output image is lower than the grayscale of the pixel in corresponding frame of input image).

By way of example, the grayscale of one of the 3800×2160 pixels in the i-th frame of input image is 160, for example, and the grayscale of the pixel in the i-th frame of output image is determined respectively as 200; and the grayscale of the pixel in the j-th frame of input image is 25, and the grayscale of the pixel in the j-th frame of output image is determined respectively as 20. That is, for one and the same pixel, the grayscale of the pixel in the i-th frame of output image is higher than the grayscale of the pixel in the i-th frame of input image, and the grayscale of the pixel in the j-th frame of output image is lower than the grayscale of the pixel in the j-th frame of input image.

It shall be noted here that the grayscale of a pixel corresponds to the transmittance ratio of the pixel, and in the embodiment of the disclosure, different grayscales correspond to different transmittance ratios. If the grayscale of any pixel in the i-th frame of output image is higher than the grayscale of the pixel in the i-th frame of input image, and the grayscale of the pixel in the j-th frame of output image is lower than the grayscale of the pixel in the j-th frame of input image, then the average of the grayscales of any pixel in the two adjacent frames of output image can be more or less than or equal to the average of the grayscales of the pixel in the two frames of input image, although the embodiment of the disclosure will not be limited thereto.

Operation 103: display the i-th frame and the j-th frame of input image.

That is, data voltage corresponding to the respective pixels is output by a display module of the four-domain liquid crystal TV set to display the i-th frame and the j-th frame of output image on the display device.

It shall be noted that in the operation 201 and the operation 202 above, the grayscales of the respective pixels in the i-th frame of input image are obtained, and the grayscales of the respective pixels in the j-th frame of input image are obtained; and the grayscales of the respective pixels in the i-th frame of output image are determined from the grayscales of the respective pixels in the i-th frame of input image, and the grayscales of the respective pixels in the j-th frame of output image are determined from the grayscales of the respective pixels in the j-th frame of input image. The embodiment of the disclosure will not be limited to any particular order in which these processing operations are performed. For example, alternatively the grayscales of the respective pixels in the i-th frame of input image can be obtained; the grayscales of the respective pixels in the i-th frame of output image can be determined from the grayscales of the respective pixels in the i-th frame of input image; and the i-th frame of input image can be displayed; and thereafter the grayscales of the respective pixels in the j-th frame of input image can be obtained; the grayscales of the respective pixels in the j-th frame of output image can be determined from the grayscales of the respective pixels in the j-th frame of input image; and the i-th frame of input image can be displayed, as long as the grayscale of any pixel in the i-th frame of output image is higher than the grayscale of the pixel in the i-th frame of input image, and the grayscale of the pixel in the j-th frame of output image is lower than the grayscale of the pixel in the j-th frame of input image.

The embodiment of the disclosure provides such an image display method that the grayscales of the respective pixels in the i-th frame and the j-th frame of input image are obtained, the grayscales of the respective pixels in the i-th frame of output image are determined from the grayscales of the respective pixels in the i-th frame of input image, and the grayscales of the respective pixels in the j-th frame of output image are determined from the grayscales of the respective pixels in the j-th frame of input image, where the grayscale of any pixel in the i-th frame of output image is higher than the grayscale of the pixel in the i-th frame of input image, and the grayscale of the pixel in the j-th frame of output image is lower than the grayscale of the pixel in the j-th frame of input image, so the display angle of view characteristic can be improved due to the temporal integration effect in human eyes, that is, a display effect from the angle of view of eight zones can be achieved on the four-domain display device to thereby achieve both a high transmittance ratio and a large angle of view on the ultra-high-definition display without modifying the display panel.

Optionally the operation 201 above includes obtaining the i-th frame and the j-th frame of input image at a third frequency and obtaining the grayscales of the respective pixels in the i-th frame and the j-th frame of input image; and the operation 203 above includes displaying the i-th frame and the j-th frame of output image at the third frequency.

The second embodiment differs from the first embodiment in that in the second embodiment, the i-th frame and the j-th frame of input image are obtained at the same frequency as the frequency at which the i-th frame and the j-th frame of output image are displayed. In the second embodiment, the displayed grayscale can be the superimposition of the grayscales in the two frames of output image due to the integration effect in human eyes to thereby further improve the display resolution.

Optionally in the operation 202 above, the grayscales of the respective pixels in the i-th frame of output image are determined from the grayscales of the respective pixels in the i-th frame of input image by determining the grayscales of the respective pixels in the i-th frame of output image from the grayscales of the respective pixels in the i-th frame of input image according to a preset relationship between the grayscales of the respective pixels in the frame of input image and the grayscales of the respective pixels in the frame of output image; and/or The grayscales of the respective pixels in the j-th frame of output image are determined from the grayscales of the respective pixels in the j-th frame of input image by determining the grayscales of the respective pixels in the j-th frame of output image from the grayscales of the respective pixels in the j-th frame of input image according to a preset relationship between the grayscales of the respective pixels in the frame of input image and the grayscales of the respective pixels in the frame of output image.

The preset relationship between the grayscales of the respective pixels in the frame of input image and the grayscales of the respective pixels in the frame of output image can be the same as the preset relationship between the grayscales of the respective pixels in the frame of input image and the grayscales of the respective pixels in the frame of output image in the first embodiment. Alternatively the preset relationship can be as illustrated in FIG. 8, which is a lookup table including the grayscales of the pixels in the frame of input image and the grayscales of the pixels in the frame of output image, and the grayscales of the respective pixels in the two adjacent frames of output image are determined by referring to the lookup table as illustrated in FIG. 8. Alternatively the preset relationship between the grayscales of the respective pixels in the frame of input image and the grayscales of the respective pixels in the frame of output image can be stored as a calculation relationship or another relationship, although the lookup table in the form illustrated in FIG. 8 has been described in the embodiment of the disclosure merely as an example.

Reference can be made to the particular description in the first embodiment for the lookup table illustrated in FIG. 8 and particularly how to derive the lookup table as illustrated in FIG. 8, so a repeated description thereof will be omitted here.

Optionally if the grayscale of a pixel in the i-th frame of input image lies in grayscale intervals of 0 to 25 and 230 to 255, then the difference between the transmittance ratio corresponding to the grayscale of the pixel in the i-th frame of output frame and the transmittance ratio corresponding to the grayscale of the pixel in the i-th frame of input image is no more than 10%; and if the grayscale of a pixel in the i-th frame of input image lies in a grayscale interval of 26 and 229, then the difference between the transmittance ratio corresponding to the grayscale of the pixel in the i-th frame of output frame and the transmittance ratio corresponding to the grayscale of the pixel in the i-th frame of input image is no more than 40%; and/or If the grayscale of a pixel in the j-th frame of input image lies in grayscale intervals of 0 to 25 and 230 to 255, then the difference between the transmittance ratio corresponding to the grayscale of the pixel in the j-th frame of output frame and the transmittance ratio corresponding to the grayscale of the pixel in the j-th frame of input image is no more than 10%; and if the grayscale of a pixel in the j-th frame of input image lies in a grayscale interval of 26 and 299, then the difference between the transmittance ratio corresponding to the grayscale of the pixel in the j-th frame of output frame and the transmittance ratio corresponding to the grayscale of the pixel in the j-th frame of input image is no more than 40%.

This is because for a relatively white grayscale lying in the grayscale interval of 0 to 25 and a relatively black grayscale lying in the grayscale interval of 230 to 255, an increase in grayscale has an insignificant influence on the transmittance ratio, whereas for a moderate grayscale lying in the grayscale interval of 26 to 229, an increase in grayscale has a significant influence on the transmittance ratio, so optionally in order to avoid an influence upon brightness deviations in black and white fields, when the grayscale is relatively white or black, the difference between the transmittance ratio corresponding to the grayscale of the pixel in the frame of output image and the transmittance ratio corresponding to the grayscale of the pixel in the image of input image is no more than 10%, and when the grayscale is moderate, the difference between the transmittance ratio corresponding to the grayscale of the pixel in the frames of output image and the transmittance ratio corresponding to the grayscale of the pixel in the image of input image is no more than 40%.

In order to further improve the display effect in the second embodiment of the disclosure, an embodiment of the disclosure further provides a spatial compensation method such that the grayscale of one of any two adjacent pixels in the i-th frame or the j-th frame of output image is higher than the grayscale of the pixel in the frame of corresponding input image, and the grayscale of the other pixel is lower than the grayscale of the pixel in the frame of corresponding input image.

Taking as an example the j-th frame of output image which is the (i+1)-th frame of output image, as illustrated in FIG. 13, a, b, c and d represent four adjacent pixels, the grayscale of the pixel a in the i-th frame of output image is higher than the grayscale of the pixel a in the i-th frame of input image, and the grayscale of the pixel a in the (i+1)-th frame of output image is lower than the grayscale of the pixel a in the (i+1)-th frame of input image. The grayscales of the pixel b and the pixel c, adjacent to the pixel a, in the i-th frame of output image are lower than the grayscales of the pixel b and the pixel c in the i-th frame of input image, and the grayscales of the pixel b and the pixel c in the (i+1)-th frame of output image are higher than the grayscales of the pixel b and the pixel c in the (i+1)-th frame of input image.

An embodiment below of the disclosure provides an image display device corresponding to the image display method according to the second embodiment of the disclosure, and it shall be noted that respective function units included in the device below can perform corresponding operations in the method above, so the respective function units of the device will not be described in details in the embodiments below of the disclosure.

Figure 16:
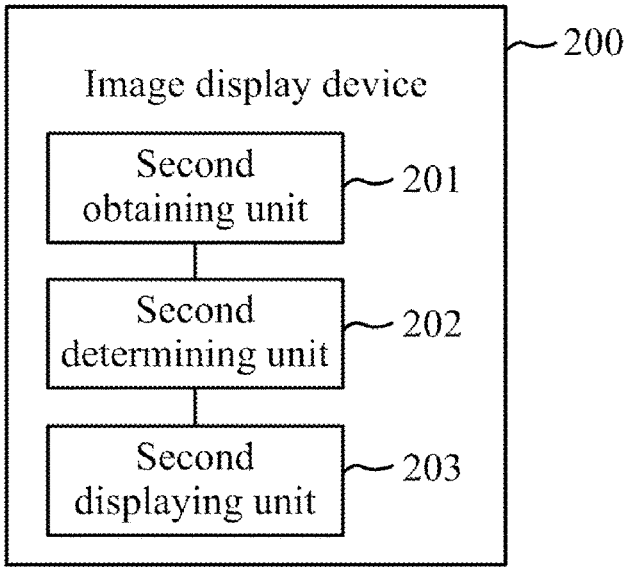
FIG. 16 illustrates a schematic diagram of an image display device according to an embodiment of the disclosure.

An embodiment of the disclosure provides an image display device 200 applicable to a multi-domain display device, and as illustrated in FIG. 16, the image display device 200 includes:

A second obtaining unit 201 is configured to obtain grayscales of respective pixels in the i-th frame and the j-th frame of input image, which are two adjacent frames.

Particularly, as illustrated in FIG. 6, the second obtaining unit can be the Tcon processing chip, or the second obtaining unit can be another processing chip or the like with the function of obtaining the grayscales of the respective pixels in the i-th frame and the j-th frame of input image. The second obtaining unit is particularly configured to obtain the grayscales of the respective pixels in the i-th frame and the j-th frame of input image at a third frequency and to obtain the grayscales of the respective pixels in the grayscales of the respective pixels in the i-th frame and the j-th frame of input image; and particularly the third frequency can be a 60 Hz or 120 Hz.

A second determining unit 202 is configured to determine the grayscales of the respective pixels in the i-th frame of output image from the grayscales of the respective pixels in the i-th frame of input image; and to determine the grayscales of the respective pixels in the j-th frame of output image from the grayscales of the respective pixels in the j-th frame of input image, where the grayscale of any pixel in the i-th frame of output image is higher than the grayscale of the pixel in the i-th frame of input image, and the grayscale of the pixel in the j-th frame of output image is lower than the grayscale of the pixel in the j-th frame of input image.

Particularly, as illustrated in FIG. 6, the second determining unit can also be the Tcon processing chip. The second determining unit is configured to determine the grayscales of the respective pixels in the i-th frame of output image from the grayscales of the respective pixels in the i-th frame of input image according to a preset relationship between the grayscales of the respective pixels in the input image and the grayscales of the respective pixels in the output image; and/or to determine the grayscales of the respective pixels in the j-th frame of output image from the grayscales of the respective pixels in the j-th frame of input image according to a preset relationship between the grayscales of the respective pixels in the input image and the grayscales of the respective pixels in the output image. The preset relationship between the grayscales of the respective pixels in the input image and the grayscales of the respective pixels in the output image can be as illustrated in FIG. 8, which is a lookup table including the grayscales of the pixels in the input image and the grayscales of the pixels in the output image, and the grayscales of the respective pixels in the i-th frame and the j-th frame of output image are determined by referring to the lookup table as illustrated in FIG. 8.

A second displaying unit 203 is configured to display the i-th frame and the j-th frame of output image. The second displaying unit is particularly configured to display the i-th frame and the j-th frame of output image at a third frequency.

Particularly the second displaying unit can be the display module as illustrated in FIG. 6. Particularly the source driver in the display module can receive the grayscales of the respective pixels in the frame of input image from the Tcon processing module and receive the reference voltage from the Gamma voltage processing chip, and then calculate and output data voltage of the respective pixels in the frame of input image to the respective pixels through the data lines. Taking a liquid crystal display device as an example, liquid crystals of different pixels are controlled by different data voltage to be deflected by different angles so that corresponding grayscales are displayed by the pixels.

The embodiment of the disclosure provides such an image display device that the grayscales of the respective pixels in the i-th frame and the j-th frame of input image are obtained, the grayscales of the respective pixels in the i-th frame of output image are determined from the grayscales of the respective pixels in the i-th frame of input image, and the grayscales of the respective pixels in the j-th frame of output image are determined from the grayscales of the respective pixels in the j-th frame of input image, where the grayscale of any pixel in the i-th frame of output image is higher than the grayscale of the pixel in the i-th frame of input image, and the grayscale of the pixel in the j-th frame of output image is lower than the grayscale of the pixel in the j-th frame of input image, so the display angle of view characteristic can be improved due to the temporal integration effect in human eyes, that is, a display effect from the angle of view of eight zones can be achieved on the four-domain display device to thereby achieve both a high transmittance ratio and a large angle of view on the ultra-high-definition display without modifying the display panel.

An embodiment of the disclosure provides a multi-domain display device including the image display device according to the second embodiment of the disclosure.

Figure 17:
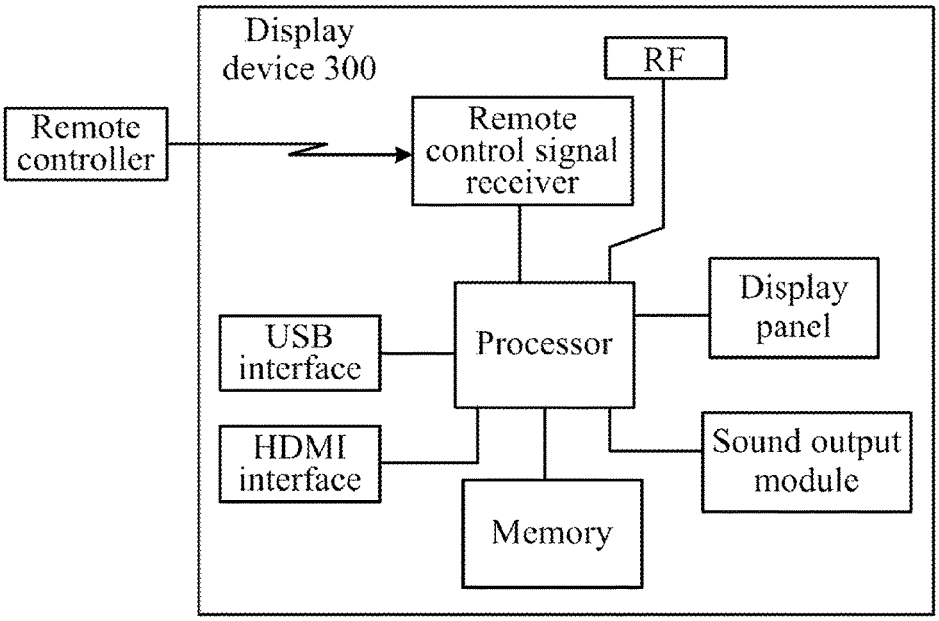
FIG. 17 illustrates a schematic diagram of another image display device according to an embodiment of the disclosure.

Moreover as illustrated in FIG. 17, an embodiment of the disclosure provides an image display device 300 which can include a memory, an input unit, an output unit, one or more processors and other components. The display device 300 can have its processor or processors execute computer readable program codes stored in the memory to perform the functions of the respective units in the display device 100 or the display device 200 according to the first embodiment or the second embodiment. Those skilled in the art can appreciate that the structure illustrated in FIG. 17 will not be intended to be limiting on the display device, but more or less components than those as illustrated can be included or some of the components can be combined or the components can be arranged differently, where:

The memory can be configured to store software programs and modules, and the processor or processors is or are configured to run the software programs and the modules stored in the memory to thereby perform various function applications and data processing. The memory can include a high-speed random access memory and can further include a nonvolatile memory, e.g., at least one magnetic-disk memory device, a flash memory device or another volatile solid memory device. Correspondingly the memory can further include a memory controller configured to provide an access of the processor or the processors and the input device to the memory; and The processor or processors is or are a control center of the display device, has the respective components of the display device connected by various interfaces and lines, and runs or executes the software programs and/or the modules stored in the memory and invokes the data stored in the memory to perform the various functions of the display device and to process the data to thereby manage and control the display device as a whole. Optionally the processor or processors can include one or more processing cores; and the processor or processors can be integrated with an application processor and a modem processor, where the application processor generally handles the operating system, the user interfaces, the applications, etc., and the modem processor generally handles wireless communication. As can be appreciated, the modem processor above may not be integrated into the processor or processors.

The display device can further include a TV and radio receiver, a high-definition multimedia interface, a USB interface, an audio and video input structure and other input units, and the input unit can further include a remote control receiver to receive a signal transmitted by a remote controller. Moreover the input unit can further include a touch sensitive surface and other input devices, where the touch sensitive surface can be embodied in various types of resistive, capacitive, infrared, surface sound wave and other types, and the other input device can include but will not be limited to one or more of a physical keyboard, functional keys (e.g., volume control press keys, a power-on or-off press key, etc.), a track ball, a mouse, a joystick, etc.

The output unit is configured to output an audio signal, a video signal, an alert signal, a vibration signal, etc. The output unit can include a display panel, a sound output module, etc. The display panel can be configured to display information input by the user or information provided to the user and various graphic user interfaces of the display device, where these graphic user interfaces can be composed of graphics, texts, icons, videos and any combination thereof. For example, the display panel can be embodied as a Liquid Crystal Display (LCD), an Organic Light-Emitting Diode (OLED), a flexible display, a 3D display, a CRT, a plasmas display panel, etc.

The display device can further include at least one sensor (not illustrated), e.g., an optical sensor, a motion sensor and other sensors. Particularly the optical sensor can include an ambient optical sensor and a proximity sensor, where the ambient optical sensor can adjust the brightness of the display panel according to the luminosity of ambient light rays, and the proximity sensor can power off the display panel and/or a backlight when the display device moves to some position. The display device can be further configured with a gyroscope, a barometer, a hygrometer, a thermometer, an infrared sensor and other sensors.

The display device can further include an audio circuit (not illustrated), and a speaker and a transducer can provide an audio interface between the user and the display device. The audio circuit can convert received audio data into an electric signal and transmit the electric signal to the speaker, which is converted by the speaker into an audio signal for output; and on the other hand, the transducer converts a collected audio signal into an electric signal which is received by the audio circuit and then converted into audio data, and the audio data is further output to the processor or processors for processing and then transmitted to another display device, for example, or the audio data is output to the memory for further processing. The audio circuit may further include an earphone jack for communication between a peripheral earphone and the display device.

Moreover the display device can further include a Radio Frequency (RF) circuit. The RF circuit can be configured to receive and transmit a signal. Typically the RF circuit includes but will not be limited to an antenna, at least one amplifier, a tuner, one or more oscillators, a Subscriber Identifier Module (SIM) card, a transceiver, a coupler, a Low Noise Amplifier (LNA), a duplexer, etc. Moreover the display device can further include a web cam, a Bluetooth module, etc.

Moreover the display device can further include a Wireless Fidelity (WiFi) module (not illustrated). The WiFi falls into the category of short-range wireless transmittance technologies, and the display device can assist the user in receiving and transmitting an e-mail, browsing a webpage, accessing streaming media, etc., through the WiFi module by which the user is provided with a wireless access to the broadband Internet. Although the WiFi module is illustrated in FIG. 17, it can be appreciated that it may not be necessarily required for the display device but can be omitted as desired without departing from the scope of the disclosure.

An embodiment of the disclosure further provides a computer readable storage medium which can be a computer readable storage medium included in the memory in the embodiment above; or can be a separately existing computer readable storage medium which is not installed into the terminal. The computer readable storage medium stores one or more programs (in some embodiments, the computer readable storage medium can be one or more magnetic-disk storage devices, flash memory devices or other nonvolatile solid storage devices, CD-ROMs, optical memories, etc.), and the one or more programs can be executed by one or more processors to perform the display method according to the embodiment of the disclosure. For operations included in the method, reference can be made to the relevant description of the embodiments illustrated in FIG. 1 and FIG. 15, so a repeated description thereof will be omitted here.

The embodiments of the disclosure provide such an image display method and device and a multi-domain display device that the grayscale of any pixel in one of the two adjacent frames of output image is higher than the grayscale of the pixel in the frame of input image, and the grayscale of the pixel in the other frame of output image is lower than the grayscale of the pixel in the frame of input image, so the grayscale is displayed as superimposition of the grayscales in the two frames of output image due to the temporal integration effect in human eyes, and eight different directed vectors of liquid crystals, i.e., a display effect from the angle of view of eight zones, can be seen on the four-domain display device to thereby achieve both a high transmittance ratio and a large angle of view on the ultra-high-definition display without modifying the display panel.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An image display method, applicable to a display device having a multi-domain liquid crystal display panel, the method comprising:

obtaining, by the display device, a grayscale of a first pixel and a grayscale of a second pixel in an input image frame;

determining, by the display device, a grayscale of a third pixel in a first output image frame according to the grayscale of the first pixel, and a grayscale of a fourth pixel in the first output image frame according to the grayscale of the second pixel, wherein the third pixel and the fourth pixel are two adjacent pixels in the first output image frame, wherein a relative position of the third pixel in the first output image frame is the same as a relative position of the first pixel in the input image frame, wherein a relative position of the fourth pixel in the first output image frame is the same as a relative position of the second pixel in the input image frame, wherein the grayscale of the third pixel is higher than the grayscale of the first pixel, and wherein the grayscale of the fourth pixel is lower than the grayscale of the second pixel;

determining, by the display device, a grayscale of a fifth pixel in a second output image frame according to the grayscale of the first pixel, and a grayscale of a sixth pixel in the second output image frame according to the grayscale of the second pixel; wherein a relative position of the fifth pixel in the second output image frame is the same as the relative position of the third pixel in the first output image frame, wherein a relative position of the sixth pixel in the second output image frame is the same as the relative position of the fourth pixel in the first output image frame, wherein the grayscale of the fifth pixel is lower than the grayscale of the first pixel, wherein the grayscale of the sixth pixel is higher than the grayscale of the second pixel, and wherein the second output image frame and the first output image frame are adjacent frames output to the multi-domain liquid crystal display panel;

displaying, by the display device, the grayscale of the third pixel in a liquid crystal domain corresponding to the third pixel, and the grayscale of the fourth pixel in a liquid crystal domain corresponding to the fourth pixel, on the multi-domain liquid crystal display panel during a period for outputting the first output image frame; and displaying, by the display device, the grayscale of the fifth pixel in a liquid crystal domain corresponding to the fifth pixel, and the grayscale of the sixth pixel in a liquid crystal domain corresponding to the sixth pixel, on the multi-domain liquid crystal display panel during a period for outputting the second output image frame.

2. The method according to claim 1, wherein determining the grayscale of the third pixel in the first output image frame according to the grayscale of the first pixel, and the grayscale of the fourth pixel in the first output image frame according to the grayscale of the second pixel comprises:

determining the grayscale of the third pixel in the first output image frame according to the grayscale of the first pixel and a first preset relationship; and determining the grayscale of the fourth pixel in the first output image frame according to the grayscale of the second pixel and a second preset relationship.

3. The method according to claim 1, wherein determining the grayscale of the fifth pixel in the second output image frame according to the grayscale of the first pixel, and the grayscale of the sixth pixel in the second output image frame according to the grayscale of the second pixel comprises:

determining the grayscale of the fifth pixel in the second output image frame according to the grayscale of the first pixel and a third preset relationship; and determining the grayscale of the sixth pixel in the second output image frame according to the grayscale of the second pixel and a fourth preset relationship.

4. The method according to claim 1, further comprising:

in response to the grayscale of the first pixel lying between a lowest grayscale and a first grayscale greater than the lowest grayscale or between a highest grayscale and a second grayscale greater than the first grayscale and less than the highest grayscale, setting a difference between a transmittance ratio corresponding to the grayscale of the third pixel and a transmittance ratio corresponding to the grayscale of the first pixel to no more than 10% of a transmittance ratio corresponding to the highest grayscale; and in response to the grayscale of the second pixel lying between the lowest grayscale and the first grayscale or between the second grayscale and the highest grayscale, setting a difference between a transmittance ratio corresponding to the grayscale of the fourth pixel and a transmittance ratio corresponding to the grayscale of the second pixel to no more than 10% of the transmittance ratio corresponding to the highest grayscale.

5. The method according to claim 4, wherein the lowest grayscale has a value of 0, wherein the first grayscale has a value of 25, wherein the second grayscale has a value of 230, and wherein the highest grayscale has a value of 255.

6. The method according to claim 1, further comprising:

in response to the grayscale of the first pixel lying between a first grayscale greater than a lowest grayscale and a second grayscale greater than the first grayscale and less than a highest grayscale, setting a difference between a transmittance ratio corresponding to the grayscale of the third pixel and a transmittance ratio corresponding to the grayscale of the first pixel to no more than 40% of the transmittance ratio corresponding to the highest grayscale; and in response to the grayscale of the second pixel lying between the first grayscale and the second grayscale, setting a difference between a transmittance ratio corresponding to the grayscale of the fourth pixel and a transmittance ratio corresponding to the grayscale of the second pixel to no more than 40% of the transmittance ratio corresponding to the highest grayscale.

7. The method according to claim 1, further comprising:

in response to the grayscale of the first pixel lying between a first grayscale greater than a lowest grayscale, and a second grayscale greater than the first grayscale and less than a highest grayscale, setting a difference between a transmittance ratio corresponding to the grayscale of the third pixel and a transmittance ratio corresponding to the grayscale of the first pixel to between 10% and 40% of the transmittance ratio corresponding to the highest grayscale; and in response to the grayscale of the second pixel lying between the first grayscale and the second grayscale, setting a difference between a transmittance ratio corresponding to the grayscale of the fourth pixel and a transmittance ratio corresponding to the grayscale of the second pixel to between 10% and 40% of the transmittance ratio corresponding to the highest grayscale.

8. The method according to claim 1, further comprising:

in response to the grayscale of the first pixel lying between a lowest grayscale and a first grayscale greater than the lowest grayscale or between a highest grayscale and a second grayscale greater than the first grayscale and less than a highest grayscale, setting a difference between a transmittance ratio corresponding to the grayscale of the fifth pixel and a transmittance ratio corresponding to the grayscale of the first pixel to no more than 10% of the transmittance ratio corresponding to the highest grayscale; and in response to the grayscale of the second pixel lying between the lowest grayscale and the first grayscale or between the second grayscale and the highest grayscale, setting a difference between a transmittance ratio corresponding to the grayscale of the sixth pixel and a transmittance ratio corresponding to the grayscale of the second pixel to no more than 10% of the transmittance ratio corresponding to the highest grayscale.

9. The method according to claim 1, further comprising:

in response to the grayscale of the first pixel lying between a first grayscale greater than a lowest grayscale, and a second grayscale greater than the first grayscale and less than a highest grayscale, setting a difference between a transmittance ratio corresponding to the grayscale of the fifth pixel and a transmittance ratio corresponding to the grayscale of the first pixel to no more than 40% of the transmittance ratio corresponding to the highest grayscale; and in response to the grayscale of the second pixel lying between the first grayscale and the second grayscale, setting a difference between a transmittance ratio corresponding to the grayscale of the sixth pixel and a transmittance ratio corresponding to the grayscale of the second pixel to no more than 40% of the transmittance ratio corresponding to the highest grayscale.

10. The method according to claim 1, further comprising:

in response to the grayscale of the first pixel lying between a first grayscale greater than a lowest grayscale, and a second grayscale greater than the first grayscale and less than a highest grayscale, setting a difference between a transmittance ratio corresponding to the grayscale of the fifth pixel and a transmittance ratio corresponding to the grayscale of the first pixel to between 10% and 40% of the transmittance ratio corresponding to the highest grayscale; and in response to the grayscale of the second pixel lying between the first grayscale and the second grayscale, setting a difference between a transmittance ratio corresponding to the grayscale of the sixth pixel and a transmittance ratio corresponding to the grayscale of the second pixel to between 10% and 40% of the transmittance ratio corresponding to the highest grayscale.

11. The method according to claim 1, wherein determining the grayscale of the third pixel in the first output image frame according to the grayscale of the first pixel, and the grayscale of the fourth pixel in the first output image frame according to the grayscale of the second pixel comprises:

in response to the grayscale of the first pixel lying between a lowest grayscale and a highest grayscale, determining the grayscale of the third pixel in the first output image frame according to the grayscale of the first pixel, wherein the grayscale of the third pixel is higher than the grayscale of the first pixel; and in response to the grayscale of the second pixel lying between the lowest grayscale and the highest grayscale, determining the grayscale of the fourth pixel in the first output image frame according to the grayscale of the second pixel, wherein the grayscale of the fourth pixel is lower than the grayscale of the second pixel.

12. The method according to claim 11, wherein determining the grayscale of the third pixel in the first output image frame according to the grayscale of the first pixel, and the grayscale of the fourth pixel in the first output image frame according to the grayscale of the second pixel comprises:

in response to the grayscale of the first pixel being the lowest grayscale, determining the grayscale of the third pixel in the first output image frame according to the grayscale of the first pixel, wherein the grayscale of the third pixel is equal to the lowest grayscale; and in response to the grayscale of the second pixel being the lowest grayscale, determining the grayscale of the fourth pixel in the first output image frame according to the grayscale of the second pixel, wherein the grayscale of the fourth pixel is equal to the lowest grayscale.

13. The method according to claim 11, wherein determining the grayscale of the third pixel in the first output image frame according to the grayscale of the first pixel, and the grayscale of the fourth pixel in the first output image frame according to the grayscale of the second pixel comprises:

in response to the grayscale of the first pixel being the highest grayscale, determining the grayscale of the third pixel in the first output image frame according to the grayscale of the first pixel, wherein the grayscale of the third pixel is equal to the highest grayscale; and in response to the grayscale of the second pixel being the highest grayscale, determining the grayscale of the fourth pixel in the first output image frame according to the grayscale of the second pixel, wherein the grayscale of the fourth pixel is equal to the highest grayscale.

14. The method according to claim 1, wherein displaying the grayscale of the third pixel in the liquid crystal domain corresponding to the third pixel and the grayscale of the fourth pixel in the liquid crystal domain corresponding to the fourth pixel, on the multi-domain liquid crystal display panel, comprises:

obtaining a first transmittance ratio according to the grayscale of the third pixel and a first preset correspondence relationship, and driving the liquid crystal domain corresponding to the third pixel on the multi-domain liquid crystal display panel according to a first on-load voltage corresponding to the first transmittance ratio, wherein the first preset correspondence relationship is a relationship between the grayscale of the third pixel and the first transmittance ratio; and obtaining a second transmittance ratio according to the grayscale of the fourth pixel and a second preset correspondence relationship, and driving the liquid crystal domain corresponding to the fourth pixel on the multi-domain liquid crystal display panel according to a second on-load voltage corresponding to the second transmittance ratio, wherein the second preset correspondence relationship is a relationship between the grayscale of the fourth pixel and the second transmittance ratio.

15. The method according to claim 14, wherein in the first preset correspondence relationship, the second preset correspondence relationship and a reference correspondence relationship, same grayscales correspond to the same transmittance ratio, wherein the reference correspondence relationship is a relationship between an image grayscale of an input image and a reference transmittance ratio, and wherein the image grayscale of the input image comprises the grayscale of the first pixel and the grayscale of the second pixel.

16. The method according to claim 14, wherein in the first preset correspondence relationship, the second preset correspondence relationship and a reference correspondence relationship, the first transmittance ratio corresponding to the first preset correspondence relationship is greater than a reference transmittance ratio corresponding to the reference correspondence relationship, and the second transmittance ratio corresponding to the second preset correspondence relationship is less than the reference transmittance ratio corresponding to the reference correspondence relationship, at the same grayscale lying between a lowest grayscale and a highest grayscale; and wherein the reference correspondence relationship is a relationship between an image grayscale of an input image and the reference transmittance ratio, and the image grayscale of the input image comprises the grayscale of the first pixel and the grayscale of the second pixel.

17. The method according to claim 16, wherein in the first preset correspondence relationship, the second preset correspondence relationship and the reference correspondence relationship, the first transmittance ratio corresponding to the first preset correspondence relationship, the reference transmittance ratio corresponding to the reference correspondence relationship, and the second transmittance ratio corresponding to the second preset correspondence relationship are the same at the lowest grayscale.

18. The method according to claim 16, wherein in the first preset correspondence relationship, the second preset correspondence relationship and the reference correspondence relationship, the first transmittance ratio corresponding to the first preset correspondence relationship is not less than the reference transmittance ratio corresponding to the reference correspondence relationship, and the second transmittance ratio corresponding to the second preset correspondence relationship is not greater than the reference transmittance ratio corresponding to the reference correspondence relationship at the highest grayscale.

19. The method according to claim 14, wherein in the first preset correspondence relationship, the second preset correspondence relationship and a reference correspondence relationship, the first transmittance ratio corresponding to the first preset correspondence relationship is greater than a reference transmittance ratio corresponding to the reference correspondence relationship, and the second transmittance ratio corresponding to the second preset correspondence relationship is less than the reference transmittance ratio corresponding to the reference correspondence relationship, at the same grayscale lying between a lowest grayscale and a third grayscale greater than the lowest grayscale;

wherein the reference correspondence relationship is a relationship between an image grayscale of an input image and the reference transmittance ratio, the image grayscale of the input image comprises the grayscale of the first pixel and the grayscale of the second pixel, and the third grayscale is less than a highest grayscale; and wherein the first transmittance ratio corresponding to the first preset correspondence relationship is less than the reference transmittance ratio corresponding to the reference correspondence relationship, and the second transmittance ratio corresponding to the second preset correspondence relationship is greater than the reference transmittance ratio corresponding to the reference correspondence relationship, at the same grayscale lying between the third grayscale and the highest grayscale.

* * * * *